United States Patent [19]

Delbianco et al.

[11] Patent Number: 4,968,414

[45] Date of Patent: Nov. 6, 1990

[54] PROCESS FOR SINGLE-STEP COAL LIQUEFACTION

[75] Inventors: Alberto Delbianco, Magenta; Ermanno Girardi, San Donato, both of Italy

[73] Assignee: Eniricerche S.p.A., Milan, Italy

[21] Appl. No.: 251,136

[22] Filed: Sep. 29, 1988

[30] Foreign Application Priority Data

Oct. 2, 1987 [IT] Italy ..... 22120 A/87

[51] Int. Cl.[5] ..... C10G 1/06

[52] U.S. Cl. ..... 208/414; 208/419; 208/421; 208/433

[58] Field of Search ..... 208/419, 421, 433, 435, 208/414

[56] References Cited

U.S. PATENT DOCUMENTS 3,642,607 2/1972 Seitzer ..... 208/433 X
3,796,650 3/1974 Urban ..... 208/419
3,930,984 1/1976 Pitchford ..... 208/433
4,128,471 12/1978 Malone et al. ..... 208/414
4,486,293 12/1984 Garg ..... 208/433 X

*Primary Examiner*—Curtis R. Davis
*Assistant Examiner*—William C. Diemler
*Attorney, Agent, or Firm*—Birch, Stewart, Kolasch & Birch

[57] ABSTRACT

A process for the single-step coal liquefaction is disclosed, which comprises reacting the coal in an aqueous suspension with carbon monoxide in the presence of a CO-conversion catalyst selected from an alkaline hydroxide or carbonate, wherein the reaction takes place at a temperature maintained for a time of up to about 20 minutes equal to a value selected within the range of from about 300° to 370° C., and then is increased over a time within the range of from about 20 to 40 minutes, until a temperature value is reached, within the range of from about 420° to 450° C. and is kept constant for a time of up to about 20 minutes.

6 Claims, No Drawings

PROCESS FOR SINGLE-STEP COAL LIQUEFACTION

BACKGROUND OF THE INVENTION

1. Field of the Invention

The present invention relates to a process for the single-step liquefaction of coal.

2. Description of the Prior Art

Processes for coal liquefaction are known which use carbon monoxide, water and a suitable catalyst in order to produce in situ the necessary hydrogen for liquifying coal.

From the above-mentioned processes a mixture of hydrocarbons is obtained, which is constituted by asphaltene precursors, asphaltenes and oils (respectively indicated hereinunder in the present patent application as "PA", "A", "OILS"), in different mutual ratios according to the adopted operating conditions.

The present Applicant has surprisingly found that by carrying out the liquefaction reaction at determined increasing temperature values, the coal conversion process can be better controlled. Moreover, the inventors have found that it and it is possible to improve the quality of the products in terms of the mutual distribution of PA, A, OILS, as well as of the H/C ratio of the same reaction products.

The so-obtained products can be used as intermediates for the production of liquid derivatives from coal.

SUMMARY OF THE INVENTION

The process according of the present invention for the single-step liquefaction of coal, comprising reacting the same coal in an aqueous suspension with carbon monoxide in the presence of a conversion catalyst selected from an alkaline hydroxide or carbonate, is characterized in that the reaction takes place at a temperature first, maintained for a time of up to about 20 minutes, and preferably is within the range of from about 5 to 20 minutes, equal to a value selected within the range of from about 300° to 370° C., and then is increased over a time within the range of from about 20 to 40 minutes, until a temperature value is reached, which is within the range of from about 420° to 450° C., at which value it is maintained constant for a time of up to about 20 minutes and preferably within the range of from 5 to 20 minutes.

DETAILED DESCRIPTION OF THE INVENTION

The pressure under which the liquefaction of coal takes place depends both on the amount of water which is charged together with the coal to the reaction system, (i.e., in the aqueous coal suspension) which should preferably be in a weight ratio relative within the range of from 2/1 to 5/1 relative to the coal used as the starting material; and on the partial pressure of charged carbon monoxide, which should be preferably within the range of from 40 to 80 atm; said pressure is preferably selected within the range of from 150 to 300 atm.

During the liquefaction process, water is at a temperature close to, or higher than, the critical temperature, determining a density of the reaction medium within the range of from 0.07 to 0.2 g/ml.

For the reaction of conversion of CO to $CO_2$ and $H_2$, the preferred catalysts are sodium and potassium hydroxides and carbonates.

In order to better illustrate the meaning of the present invention, an example is reported hereinunder, which is not to be considered as being limitative of the invention.

EXAMPLE 1

A test was carried out on Illinois Nr. 6 coal, and the elemental analysis of which is reported in Table 1.

One gram of coal was charged to a reactor of 30 ml of capacity, together with 4 ml of a 0.1 M aqueous solution of $Na_2CO_3$.

The reactor was then pressurized with 40 atm of carbon monoxide, it was then heated to a temperature of 350° C., and was maintained at this temperature for 15 minutes. The reaction temperature was subsequently increased by 90° C. over a 30-minute time, and was maintained at 440° C. for a further 15 minutes.

When the reaction ended, the reactor was discharged and, after removing the aqueous phase, the reaction product was recovered with tetrahydrofuran (THF).

The product fraction soluble in THF was then filtered off from the unreacted coal and mineral materials.

The THF-soluble material was then treated with hexane in soxhlet, in order to separate the fraction constituted by the oils.

In total, by starting from 1 g of dmmf coal (dmmf =dry mineral matter free), when the process was ended, more than 0.9 g was recovered of a mixture of mostly non-distillable, THF-soluble hydrocarbons, 40% by of which were soluble in paraffinic solvents (oils).

The degree of hydrogenation of the mixture of THF-soluble products was increased by increasing the H/C ratio from 0.82 (the starting coal) to 1.04.

EXAMPLE 2 (COMPARATIVE EXAMPLE)

Using 1 g of Illinois Nr. 6 coal, a test analogous to the preceding one was carried out. However, the difference is that the reaction was carried out by heating the reaction mixture at 400° C. for 60 minutes.

Under the same reaction conditions, excluding the temperature, at the end of the process more than 0.9 g was recovered of a mixture of a mostly non-distillable material, but the THF-soluble hydrocarbons (H/C=1.00), 26% of which were soluble in paraffinic solvents (oils).

Therefore, carrying out the reaction at determined increasing temperature values made it possible for a mixture of hydrocarbons to be obtained, wherein the hydrocarbons soluble in paraffinic oils (oils) had increased from 26% to 40%.

TABLE 1

Immediate and End Analysis of Illinois Nr. 6 Coal

| | | Air Dried | Dry | dmmf* |
|---|---|---|---|---|
| Moisture | % | 4.57 | | |
| Ashes | % | 11.43 | 11.98 | |
| Volatile matters | % | 35.74 | 37.45 | 44.01 |
| Fixed Carbon | % | 48.26 | 50.57 | 55.99 |
| Carbon | % | 66.42 | 69.60 | 81.79 |
| Hydrogen | % | 5.06 | 4.77 | 5.60 |
| Nitrogen | % | 1.50 | 1.57 | 1.85 |
| Sulphur | % | 3.43 | 3.59 | |
| Oxygen (diff.) | % | 12.16 | 8.49 | 10.76 |

*Mineral matter = 14.91%, evaluated according to Parr Method.

We claim:

1. A process for the single-step liquefaction of coal, comprising reacting coal in an aqueous suspension with carbon monoxide in the presence of a conversion catalyst selected from an alkaline hydroxide or carbonate, wherein the reaction is caused to take place at a temperature maintained for a time up to about 20 minutes, equal to a value selected within the range from about 300° to 370° C., and then increased over a time within the range from about 20 to 40 minutes, until a temperature value is reached within the range from about 420° to 450° C. and is kept constant for a time up to about 20 minutes.

2. The process according to claim 1, wherein the weight ratio of water to coal in said aqueous suspension is in the range of from 2:1 to 5:1.

3. The process according to claim 1, wherein the partial pressure of carbon monoxide in said process is in the range of 40 to 80 ATM.

4. The process according to claim 1, wherein the pressure for said liquefaction of coal is in the range of 150 to 300 ATM.

5. The process according to claim 1, wherein the density of reaction medium is in the range of 0.07 to 0.2 g/ml.

6. The process according to claim 1, wherein the temperature is first maintained at about 300° to 370° C. for about 5 to 20 minutes, and subsequently maintained at a temperature of about 420° to 450° C. for about 5 to 20 minutes.

* * * * *